US012161163B2

(12) United States Patent
Chen et al.

(10) Patent No.: US 12,161,163 B2
(45) Date of Patent: Dec. 10, 2024

(54) HEATER AND CIGARETTE DEVICE HAVING SAME

(71) Applicant: SHENZHEN FIRST UNION TECHNOLOGY CO., LTD., Shenzhen (CN)

(72) Inventors: Wei Chen, Shenzhen (CN); Ruilong Hu, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 375 days.

(21) Appl. No.: 17/756,633

(22) PCT Filed: Nov. 27, 2020

(86) PCT No.: PCT/CN2020/132368
§ 371 (c)(1),
(2) Date: May 27, 2022

(87) PCT Pub. No.: WO2021/104471
PCT Pub. Date: Jun. 3, 2021

(65) Prior Publication Data

US 2022/0408814 A1 Dec. 29, 2022

(30) Foreign Application Priority Data

Nov. 27, 2019 (CN) ..... 201911184343.7

(51) Int. Cl.
*A24F 40/46* (2020.01)

(52) U.S. Cl.
CPC ..... *A24F 40/46* (2020.01)

(58) Field of Classification Search
CPC ..... A24F 40/46; A24F 40/20; H05B 3/04; H05B 3/42; H05B 2203/013;
(Continued)

(56) References Cited

U.S. PATENT DOCUMENTS 5,665,262 A 9/1997 Hajaligol et al.
10,321,719 B2 6/2019 Peuchert et al.
(Continued)

FOREIGN PATENT DOCUMENTS

CN 101084801 A 12/2007
CN 203828070 U 9/2014
(Continued)

*Primary Examiner* — Truc T Nguyen
(74) *Attorney, Agent, or Firm* — Cheng-Ju Chiang

(57) ABSTRACT

A heater and a cigarette device having the heater is provided. The heater includes a base having a surface, an infrared electric-heating coating layer disposed on the surface of the base, and a conductor including a first conducting part and a second conducting part disposed on the surface of the base. Both of the first conducting part and the second conducting part are at least partially electrically connected with the infrared electric-heating coating layer. The first conducting part includes a first electric conducting spiral section, and the second conducting part includes a second electric conducting spiral section. A spacing between the first electric conducting spiral section and the second electric conducting spiral section is not zero. Through the first and second electric conducting spiral sections disposed on the surface of the base, a path of electric currents flowing through the infrared electric-heating coating layer of the base is shorter.

20 Claims, 8 Drawing Sheets

(58) Field of Classification Search
CPC ..... H05B 2203/021; H05B 2203/022; H05B 2203/032
See application file for complete search history.

(56) References Cited

U.S. PATENT DOCUMENTS

| | | | | |
|---|---|---|---|---|
| 2007/0139976 | A1* | 6/2007 | deRochemont | H01G 4/10 363/17 |
| 2018/0303167 | A1 | 10/2018 | Basil | |
| 2019/0000144 | A1* | 1/2019 | Bless | H05B 1/0252 |
| 2019/0343179 | A1* | 11/2019 | Sur | A24F 40/50 |
| 2020/0060341 | A1* | 2/2020 | Sebastian | A24F 40/44 |
| 2020/0093182 | A1* | 3/2020 | Monsalud | A61M 15/06 |
| 2023/0000160 | A1* | 1/2023 | Hu | H05B 3/0033 |
| 2024/0248008 | A1* | 7/2024 | Motayed | G01N 1/2273 |
| 2024/0248248 | A1* | 7/2024 | Nichol | G02B 6/0028 |

FOREIGN PATENT DOCUMENTS

| | | | |
|---|---|---|---|
| CN | 204335822 | U | 5/2015 |
| CN | 109077358 | A | 12/2018 |
| CN | 109380766 | A | 2/2019 |
| CN | 208863605 | U | 5/2019 |
| CN | 109832674 | A | 6/2019 |
| CN | 208941045 | U | 6/2019 |
| CN | 209058134 | U | 7/2019 |
| CN | 110384264 | A | 10/2019 |
| KR | 10-1983367 | B1 | 5/2019 |

* cited by examiner

HEATER AND CIGARETTE DEVICE HAVING SAME

CROSS REFERENCE TO RELATED APPLICATIONS

The present invention is a 35 U.S.C. § 371 National Phase conversion of International (PCT) Patent Application No. PCT/CN2020/132368, filed on Nov. 27, 2020, which claims benefit of Chinese Application No. 201911184343.7, filed in Chinese Patent Office on Nov. 27, 2019 and entitled as "Heating Device and Cigarette Equipment Having the Heating Device", the disclosure of which is incorporated by reference herein. The PCT International Patent Application was filed and published in Chinese.

FIELD OF THE INVENTION

The present invention relates to a technical field of cigarette equipment, particularly relates to a heater and a cigarette device having the heater.

Description of Background Related Art

Smoking products such as cigarettes and cigars are designed to burn tobacco during their using period to generate smokes. Existing technology tries to manufacture products releasing chemicals in a non-burning condition for providing substitutes of the products burning tobacco. An example of such products is performed by so-called heating non-burning products. In other words, chemicals are released by heating tobacco rather than burning tobacco.

An existing low-temperature heating non-burning smoking equipment is designed to coat an infrared layer and an electric conducting layer on an outer surface of a basal body. After being electrified, the infrared layer transmits infrareds penetrating the basal body to heat an aerosol forming base material in the basal body. Since the infrareds have a stronger penetrability, the infrareds can penetrate an outer periphery of the aerosol forming base material to enter an inside of the aerosol forming base material. As a result, the aerosol forming base material is heated much uniformly.

In the above smoking equipment, the electric conducting layer is usually coated at two ends of the basal body. The infrared layer between the two-ended electric conducting layer is equivalent to an electric resistor. An electric resistance value of the equivalent electric resistor is usually larger. In a situation requiring promotion of heating power of the smoking equipment, raising an output voltage of the smoking equipment is usually a well-known option. However, the above option easily leads to a large loss of power consumption.

BRIEF SUMMARY OF THE INVENTION

The present invention provides a heater and a cigarette device containing the heater. They are designed to solve problem of lowering a resistance value of an equivalent electric resistor of an infrared layer coated on a basal body of an existing product.

In a first aspect, a heater in accordance with the present invention is provided. The heater includes the following.

A base of the heater is provided. The base has a surface.

An infrared electric-heating coating layer of the heater is disposed on the surface of the base. The infrared electric-heating coating layer is used to generate an infrared for radiantly heating an aerosol generating substrate in order to generate aerosols for inhaling.

A conductor of the heater includes a first conducting part and a second conducting part disposed on the surface of the base. Both of the first conducting part and the second conducting part are at least partially electrically connected with the infrared electric-heating coating layer so that electric currents travel through the infrared electric-heating coating layer from one of the first conducting part and the second conducting part toward the other of the first conducting part and the second conducting part.

In particular, the first conducting part includes a first electric conducting spiral section, and the second conducting part includes a second electric conducting spiral section. A spacing between the first electric conducting spiral section and the second electric conducting spiral section is not zero.

In a second aspect, a cigarette device in accordance with the present invention is provided. In particular, the cigarette device includes a housing assembly and the heater described in the first aspect above. The heater is disposed in the housing assembly.

The present invention provides a heater and a cigarette device containing the heater. Through the first electric conducting spiral section and the second electric conducting spiral section disposed on the surface of the base, a path of electric currents flowing through the infrared electric-heating coating layer of the base is shorter. As a result, an electric resistance value of an equivalent electric resistor of the infrared electric-heating coating layer is therefore lowered. Efficiency of the heater is hence promoted.

BRIEF DESCRIPTION OF THE DRAWINGS

One or more embodiments in accordance with the present invention are illustratively exemplified for explanation through figures shown in the corresponding attached drawings. These exemplified descriptions do not constitute any limitation on the embodiments. The elements with the same reference numerals in the attached drawings are denoted as similar elements. Unless otherwise stated, the figures in the attached drawings do not constitute any scale limitation.

DETAILED DESCRIPTION OF THE INVENTION

In order to facilitate best understanding of the present invention, the present invention will be illustrated in more detail below in conjunction with the attached drawings and preferred embodiments. It should be noted that when an element is expressed as "being fixed to/being fixedly connected to" another element, this element may be directly on the another element, or there may be one or more intervening elements between this element and the another element. When an element is expressed as "being connected to" another element, this element can be directly connected to the another element, or there may be one or more intervening elements between this element and the another element. Terminology used in the specification such as "upper", "lower", "left", "right", "inside", "outside", or similar expressions, etc., is only used for descriptive purposes.

Unless otherwise defined, any technical and scientific terminology used in this specification has the same meaning as commonly understood by those skilled in the technical field of the present invention. Terminology used in this specification of the present invention is only for a purpose of describing specific embodiments, and is not used to limit the present invention. Terminology such as "and/or" used in this specification includes any and all combinations of one or more related listed items.

Embodiment 1

Figure 1:
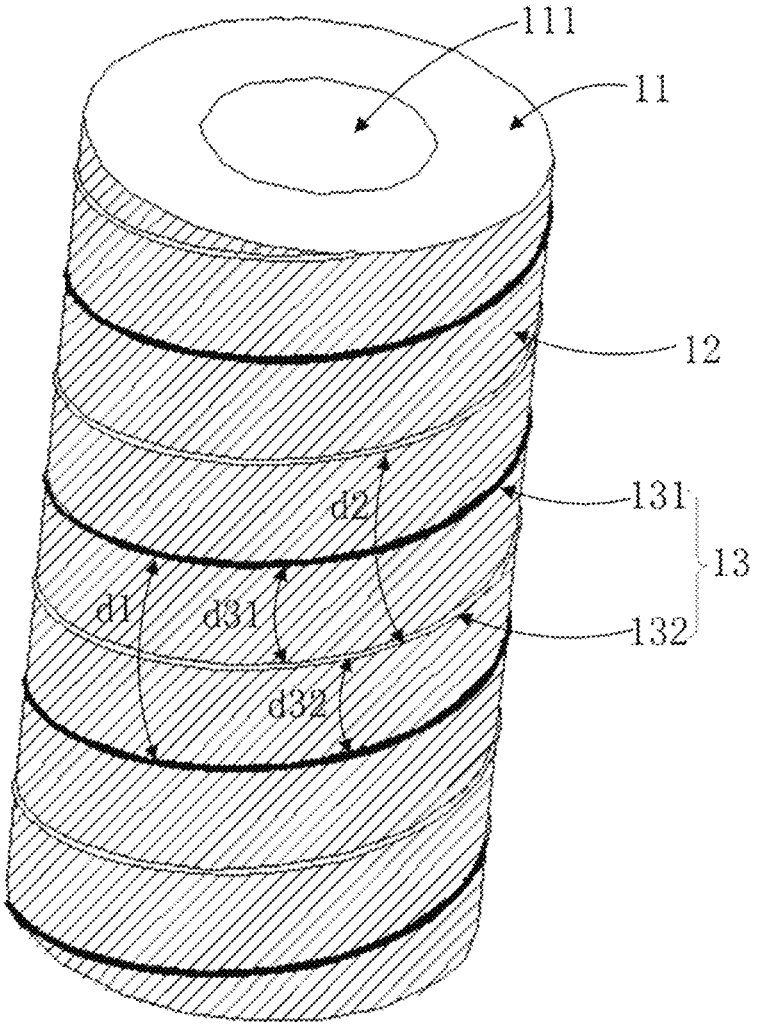
FIG. 1 shows a schematic perspective view of a heater having an electric conducting spiral section in an equidistant spacing in accordance with a first preferred embodiment of the present invention.

Referring to FIG. 1, a heater 1 in accordance with a first embodiment of the present invention is shown. The heater 1 includes a base 11, an infrared electric-heating coating layer 12 and a conductor 13.

A cavity 111 is formed in the base 11 and is adapted for receiving an aerosol generating substrate.

In particular, the base 11 includes a first end and a second end oppositely disposed to each other. The cavity 111 adapted for receiving the aerosol generating substrate is formed in an inner hollow of the base 11 extending longitudinally between the first end and the second end. The base 11 can be cylindrical, prismatic or in other columnar shapes. The base 11 is preferably cylindrical. The cavity 111 is therefore a cylindrical hole penetrating through a middle of the base 11. An inner diameter of the cylindrical hole is slightly larger than an outer diameter of an aerosol generating product or a smoking product. As a result, the aerosol generating product or the smoking product can be conveniently disposed in the cavity 111 to be heated therein.

The base 11 can be made from high-temperature resistant and transparent materials, such as quartz glass, ceramic or mica, etc. The base 11 can also be made from other materials having higher infrared transmittance. For instance, the base 11 can be made from a high-temperature resistant material having an infrared transmittance being more than 95%. Material of the base 11 is not particularly limited herein.

The aerosol generating substrate is a substrate being able to release volatile compounds forming aerosols. The volatile compounds can be released via heating the aerosol generating substrate. The aerosol generating substrate can be solid or liquid, or a composition including solid and liquid. The aerosol generating substrate can be absorbed, coated, immersed or loaded in other ways to a carrier and a supporting piece. The aerosol generating substrate can be conveniently a part of the aerosol generating product or the smoking product.

The aerosol generating substrate can include nicotine. The aerosol generating substrate can include tobacco. For instance, the aerosol generating substrate can include a tobacco-contained material containing volatile tobacco favor compounds. The volatile tobacco favor compounds are released from the aerosol generating substrate when the aerosol generating substrate is heated. Preferably, the aerosol generating substrate can contain a uniform tobacco material, such as deciduous tobacco. The aerosol generating substrate can contain at least an aerosol generating agent. The aerosol generating agent can be any suitable well-known compounds or mixtures of compounds. In use, the compounds or mixtures of compounds facilitate forming of compact and steady aerosols, and basically have resistance to thermal degradation under an operation temperature of an aerosol generating system. Proper aerosol generating agents are well known in the art of the present invention, and include, but do not be limited to, polyalcohol such as triethylene glycol, 1,3-butanediol and glycerol, polyalcohol ester such as glycerol mono-, di-, or tri-acetate, and mono-, di-, or poly-carboxylic acid of fatty acid ester such as dodecanedioic acid dimethyl ester, tetradecanedioic acid, 1,14-dimethyl ester. Preferably, the aerosol generating agent is polycarboxylic alcohol or mixtures thereof, such as triethylene glycol, 1,3-butanediol, and preferably glycerine.

The infrared electric-heating coating layer 12 is coated on a surface of the base 11. The infrared electric-heating coating layer 12 can be coated on an outer surface of the base 11, and can be coated on an inner surface of the base 11. Preferably, the infrared electric-heating coating layer 12 is coated on the outer surface of the base 11.

The infrared electric-heating coating layer 12 can generate heat energy under an electrifying situation, and generate an infrared with a certain wavelength, such as an infrared with a wavelength of 8 μm~15 μm. When the wavelength of the infrared is matched with an absorbing wavelength of the aerosol generating substrate, energy of the infrared is prone to being absorbed by the aerosol generating substrate. In the current preferred embodiment of the present invention, a wavelength of the infrared is not limited, and the infrared can be an infrared with a wavelength ranged within 0.75 μm~1,000 μm, preferably an infrared with a wavelength ranged within 1.5 μm~ 400 μm.

The infrared electric-heating coating layer 12 is preferably coated and printed on the outer surface of the base 11 after infrared electric-heating ink, ceramic powers and inorganic adhesives are blended uniformly and stirred completely for coating, and is then baked to be dried and solidified for a certain time period. A thickness of the infrared electric-heating coating layer 12 is 30 μm~50 μm. Of course, the infrared electric-heating coating layer 12 can further be coated to cover the outer surface of the base 11 after tin tetrachloride, tin oxide, antimony trichloride, titanium tetrachloride and cupric sulphate anhydrous are blended based on a certain ratio and stirred for coating. Alternatively, the infrared electric-heating coating layer 12 is one of a silicon carbide ceramic layer, a carbon fiber composite layer, a zirconium titanium series oxide ceramic layer, a zirconium titanium series nitride ceramic layer, a zirconium titanium series boride ceramic layer, a zirconium titanium series carbide ceramic layer, a ferrous series oxide ceramic layer, a ferrous series nitride ceramic layer, a ferrous series boride ceramic layer, a ferrous series carbide ceramic layer, a rare earth series oxide ceramic layer, a rare earth series nitride ceramic layer, a rare earth series boride ceramic layer, a rare earth series carbide ceramic layer, a nickel cobalt series oxide ceramic layer, a nickel cobalt series nitride ceramic layer, a nickel cobalt series boride ceramic layer, a nickel cobalt series carbide ceramic layer, or a high silicon molecular sieve ceramic layer. The infrared electric-heating coating layer 12 can further be other existing material coating layers.

In a preferred embodiment of the present invention, the heater 1 further includes a protective layer (not shown in figures) coated on the infrared electric-heating coating layer 12, and/or includes a protective structure disposed on the infrared electric-heating coating layer 12. The protective layer can be a combination of one or two of a polytetrafluoroethylene layer and a glaze layer, or a protective layer made from other high-temperature resistant materials. The protective structure can be an assembly or a part to separate the aerosol generating product or the smoking product from the infrared electric-heating coating layer 12. A gap can be formed between the protective structure and the infrared electric-heating coating layer 12 or the aerosol generating product. The protective layer and/or the protective structure can be used to avoid abrasion of the infrared electric-heating coating layer 12 caused, for instance, by entry of the aerosol generating product (for example, a cigarette) into the cavity 111 or exit of the aerosol generating product out of the cavity 111.

The conductor 13 includes a first conducting part 131 and a second conducting part 132 disposed on the surface of the base 11. Both of the first conducting part 131 and the second conducting part 132 are at least partially electrically connected with the infrared electric-heating coating layer 12 so that electric currents can travel through the infrared electric-heating coating layer 12 from one of the first conducting part 131 and the second conducting part 132 toward the other of the first conducting part 131 and the second conducting part 132. An electrode set for the first conducting part 131 is opposite to an electrode set for the second conducting part 132. For instance, the first conducting part 131 is set as a positive electrode while the second conducting part 132 is set as a negative electrode. Alternatively, the first conducting part 131 is set as a negative electrode while the second conducting part 132 is set as a positive electrode. Preferably, the infrared electric-heating coating layer 12 is coated to cover the outer surface of the base 11, and the conductor 13 is disposed on the outer surface of the base 11.

In the first preferred embodiment of the present invention as shown in FIG. 1, the first conducting part 131 and the second conducting part 132 respectively include only an electric conducting spiral section. In particular, the first conducting part 131 and the second conducting part 132 respectively extend in an equidistant spiral spacing along a longitudinal direction (i.e., an axial direction of a cylinder) of the cylindrical base 11 (Using the first conducting part 131 shown in FIG. 1 as an example, a distance d1 between two neighboring black lines is set to be same along the longitudinal direction of the cylindrical base 11; similarly to the second conducting part 132, a distance d2 between two neighboring white lines is set to be same). As a result, two cylindrical spiral lines are formed on the surface of the base 11. The two cylindrical spiral lines do not intersect with each other. In other words, a spacing between the first conducting part 131 and the second conducting part 132 (as shown as d31, d32 in figures) is not zero.

In the first preferred embodiment of the present invention as shown in FIG. 1, the spiral distance d1 of the first conducting part 131 is equal to the spiral distance d2 of the second conducting part 132 (i.e., d1=d2). Besides, the first conducting part 131 and the second conducting part 132 are equidistantly disposed on the outer surface of the base 11 (i.e., d31=d32).

Figure 2:
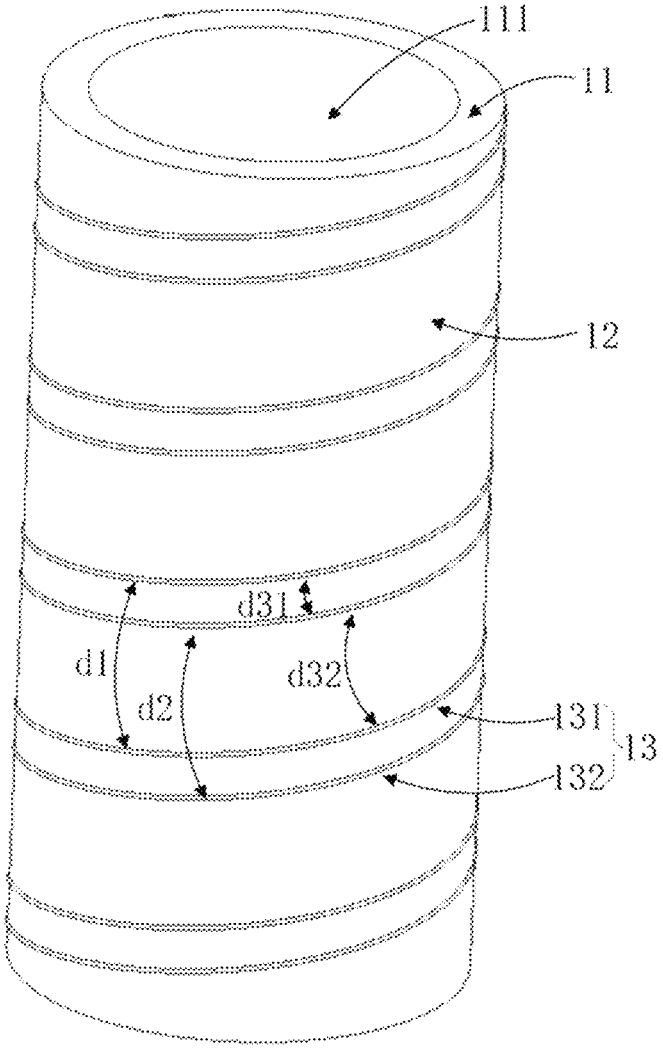
FIG. 2 shows a schematic perspective view of a heater having an electric conducting spiral section in an equidistant spiral distance but in an unequal spacing in accordance with a first preferred embodiment of the present invention.

Please refer to FIG. 2. In a preferred embodiment of the present invention, the first conducting part 131 and the second conducting part 132 respectively extend in an equidistant spiral spacing along the longitudinal direction of the cylindrical base 11. The spiral distance d1 of the first conducting part 131 is equal to the spiral distance d2 of the second conducting part 132 (i.e., d1=d2). However, the first conducting part 131 and the second conducting part 132 are disposed in unequal spacings on the outer surface of the base 11 (i.e., d31≠d32).

Figure 3:
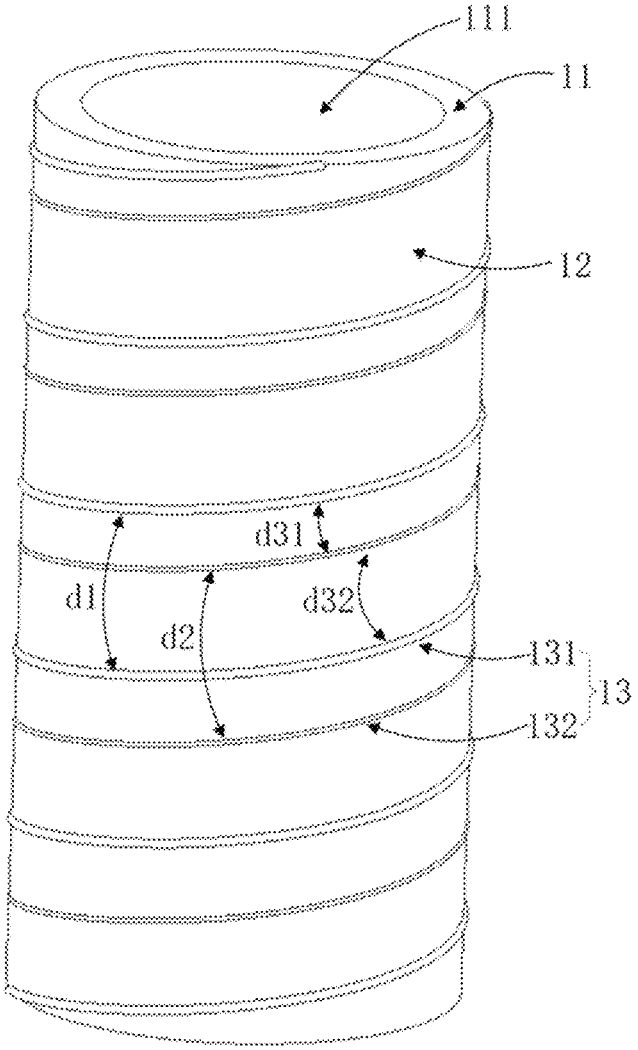
FIG. 3 shows a schematic perspective view of a heater having an electric conducting spiral section in an unequal spiral distance and in an unequal spacing in accordance with a first preferred embodiment of the present invention.

Please refer to FIG. 3. In a preferred embodiment of the present invention, the first conducting part 131 and the second conducting part 132 respectively extend in an equidistant spiral spacing along the longitudinal direction of the cylindrical base 11. However, the spiral distance d1 of the first conducting part 131 is unequal to the spiral distance d2 of the second conducting part 132 (i.e., d1≠d2). Besides, the first conducting part 131 and the second conducting part 132 are disposed in unequal spacings on the outer surface of the base 11 (i.e., d31≠d32).

It is necessary to explain that, in the preferred embodiments shown in FIGS. 1-3, the design method by which the first conducting part 131 and the second conducting part 132 are respectively disposed in an equidistant spiral spacing along the longitudinal direction of the cylindrical base 11 is an equivalent design for the infrared electric-heating coating layer 12 extending along the longitudinal direction of the cylindrical base 11 to be electrically parallel connected with resistors having a same electric resistance value. Heating of every of the resistors is substantially same. As a result, uniform heating of the heater 1 can be effectively reached. Correspondingly, the other two embodiments also have advantages of higher heating efficiency.

Figure 4:
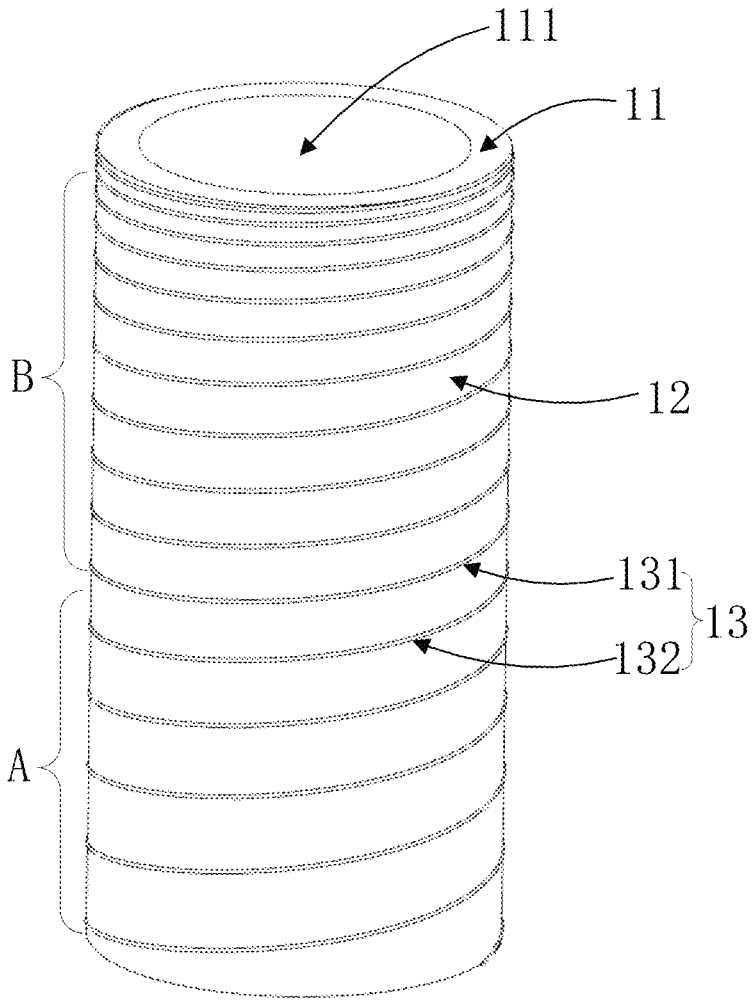
FIG. 4 shows a schematic perspective view of a heater having an electric conducting spiral section with different spiral densities in accordance with a first preferred embodiment of the present invention.

Please refer to FIG. 4. In a preferred embodiment of the present invention, the first conducting part 131 and the second conducting part 132 respectively extend in a varying spiral spacing along the longitudinal direction of the cylindrical base 11. The outer surface of the base 11 includes a first area (as shown as an area A in the figure) and a second area (as shown as an area B in the figure). A spiral spacing of the first conducting part 131 in the first area A is larger than a spiral spacing of the first conducting part 131 in the second area B. Besides, a spiral spacing of the second conducting part 132 in the first area A is larger than a spiral spacing of the second conducting part 132 in the second area B. As a result, a spiral density of the first conducting part 131 and the second conducting part 132 in the first area A is smaller than a spiral density of the first conducting part 131 and the second conducting part 132 in the second area B due to sizes of the above spiral spacings. It can be imaginable that a resistance value of an equivalent resistance of the second area B is relatively lower than a resistance value of an equivalent resistance of the first area A, and a heating efficiency of the second area B is higher since the spiral density of the first area A is smaller than the spiral density of the second area B. It is also imaginable that more than two areas having different spiral densities can be disposed on the outer surface of the base 11, such as a third area being disposed. In the third area, the first conducting part 131 and the second conducting part 132 can extend in an equidistant spiral spacing or in a varying spiral spacing. A size of the spiral spacing for the first conducting part 131 and the second conducting part 132 is not limited herein, and can be applied same as in the above embodiments.

It is necessary to illustrated that, in the above embodiment, the first area A is disposed near an upstream part of the aerosol generating substrate (in reference to an airflow direction flowing through the aerosol generating substrate) while the second area B is disposed near a downstream part of the aerosol generating substrate.

In other embodiments, the first conducting part 131 extends in an equidistant spiral spacing along the longitudinal direction of the base 11 while the second conducting part 132 extends in a varying spiral spacing along the longitudinal direction of the base 11. Alternatively, it is also feasible that the first conducting part 131 extends in a varying spiral spacing along the longitudinal direction of the base 11 while the second conducting part 132 extends in an equidistant spiral spacing along the longitudinal direction of the base 11. In practice, spiral spacings of the first conducting part 131 and the second conducting part 132 are not limited herein.

It should be illustrated that, in the above embodiments, the first conducting part 131 and the second conducting part 132 are respectively disposed alternately on the outer surface of the cylindrical base 11, and they are both sinistrally spiral or both dextrally spiral. In other embodiments, it is feasible when the first conducting part 131 and the second conducting part 132 are not disposed alternately on the outer surface of the cylindrical base 11.

Figure 5:
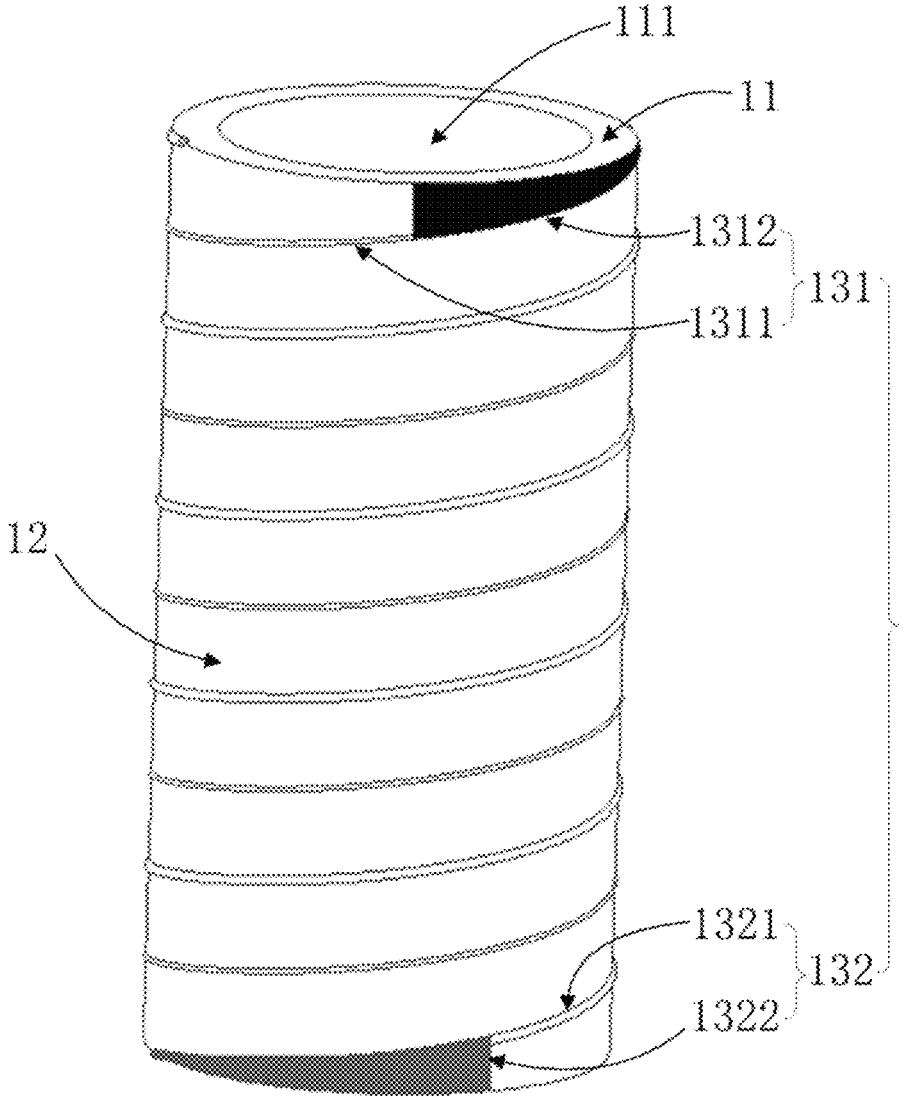
FIG. 5 shows a schematic perspective view of a heater having an electric conducting spiral section and an electric conducting non-spiral section in accordance with a first preferred embodiment of the present invention.

Please further refer to FIG. 5. In a preferred embodiment of the present invention, the first conducting part 131 includes an electric conducting spiral section 1311 and an electric conducting non-spiral section 1312. The second conducting part 132 includes an electric conducting spiral section 1321 and an electric conducting non-spiral section 1322. The electric conducting spiral section 1311 and the electric conducting spiral section 1321 can be referred to the above illustrating content, and will not be repeated herein. A shape of the electric conducting non-spiral section 1312 and the electric conducting non-spiral section 1322 can be substantially triangular as shown in the figure, and can be alternatively in a strip shape, or other shapes. On the one hand, the electric conducting non-spiral section 1312 and the electric conducting non-spiral section 1322 can be used to enlarge areas of the conducting parts 131, 132. On the other hand, they are adapted for electrical connection with outside conductors (such as soldering, etc.).

Figure 6:
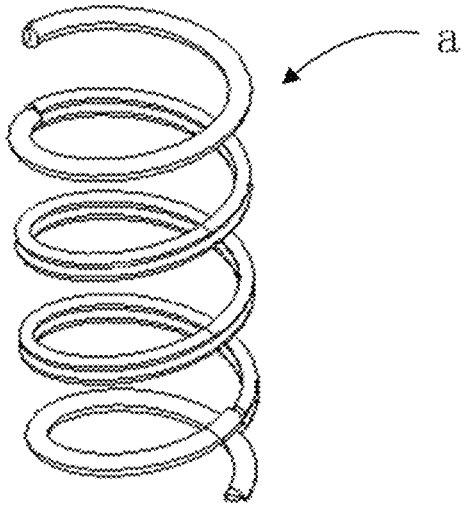
FIG. 6 shows a schematic perspective view of a spiral electric conducting piece in accordance with a first preferred embodiment of the present invention.

In the above embodiments, the first conducting part 131 and the second conducting part 132 can be spiral electric conducting coating layers formed on and coated to cover the outer surface of the base 11. The electric conducting coating layers are metal coating layers or electric conducting tapes, etc. The metal coating layers can be made from metal including silver, gold, palladium, platinum, copper, nickel, molybdenum, tungsten, or niobium, etc., or alloy material of the previously mentioned metals. Referring to FIG. 6, they can also be a spiral electric conducting piece a adhered and attached to the outer surface of the base 11. The spiral electric conducting piece a is a metal electric conducting piece, such as a copper piece, a steel piece, etc.

In the above embodiments, an electrical conductivity of the first conducting part 131 and an electrical conductivity of the second conducting part 132 are both higher than an electrical conductivity of the infrared electric-heating coating layer 12.

Figure 8:
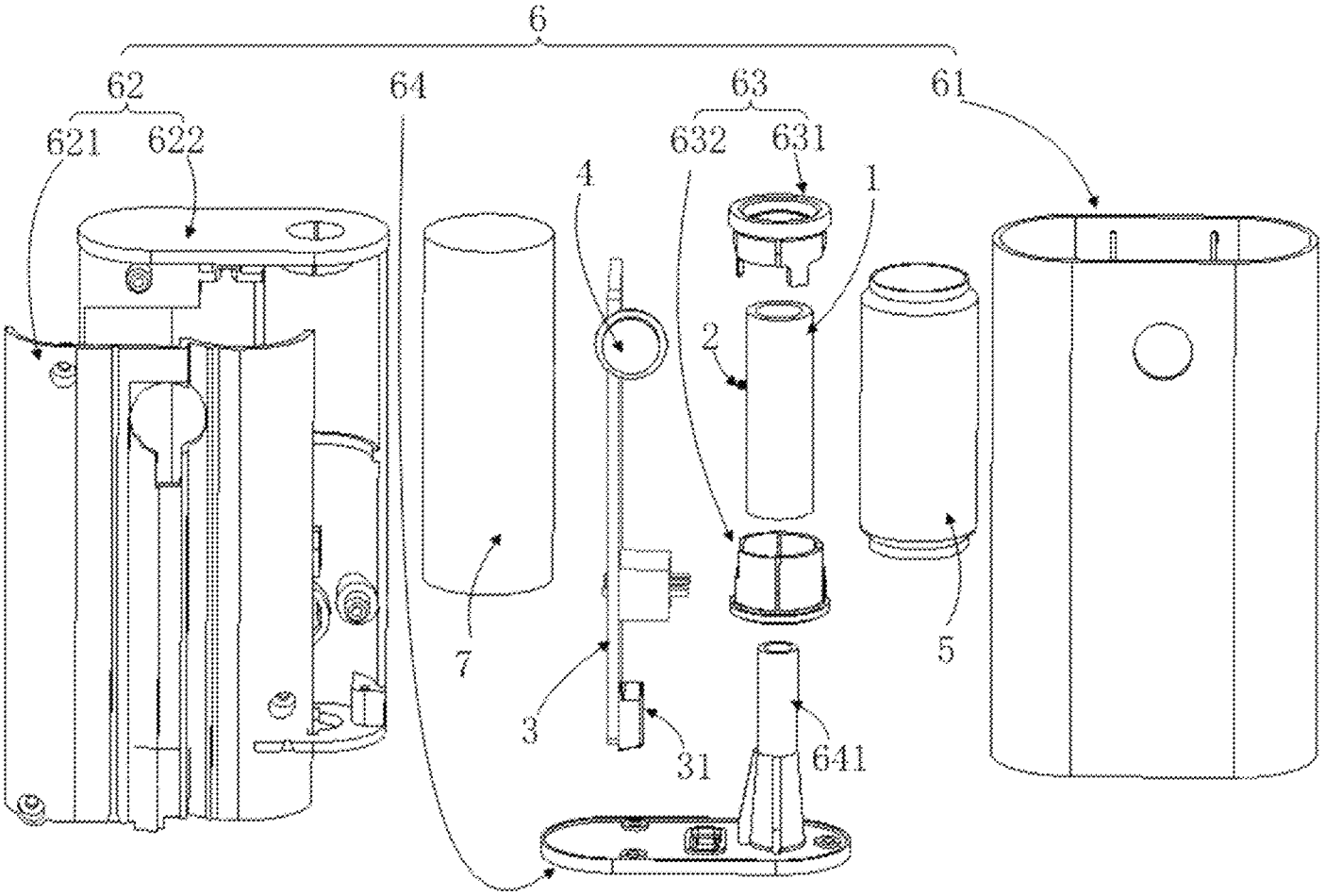
FIG. 8 shows a schematic exploded perspective view of FIG. 7.

In a preferred embodiment of the present invention, the heater 1 further includes a hollow thermal insulative tube 5 (Referring to FIG. 8).

The thermal insulative tube 5 is disposed to surround outside the base 11. The thermal insulative tube 5 can be used to avoid extreme heat transmitted to an outer shell of smoking equipment so that users of the smoking equipment feel hand burning.

In the above embodiment, since heat in the infrared electric-heating coating layer 12 is transmitted outwards and spread in thermal conduction or thermal convection, an inner surface of the thermal insulative tube 5 is further equipped and coated with a reflective coating layer in order to reflect infrareds transmitted from the infrared electric-heating coating layer 12 on the base 11 back to an inside of the base 11 for heating the aerosol generating substrate disposed in the cavity 111 and therefore for enhancing heating efficiency. On the other hand, such reflection facilitates an effect of thermal insulation so that an excessively high temperature of the outer shell of the smoking equipment to degrade user experience is avoided.

In the above embodiment, the reflective coating layer is made from material includes at least one kind of metals or metal oxides. In particular, the material can be made from one or more of gold, silver, nickel, aluminum, gold alloy, silver alloy, nickel alloy, aluminum alloy, gold oxide, silver oxide, nickel oxide and aluminum oxide, titanium oxide, zinc oxide, and cerium oxide. A thickness of the reflective coating layer is in a range of 0.3 μm~200 μm.

In the above embodiment, the thermal insulative tube 5 includes thermal insulative material. The thermal insulative material can be thermal insulative rubber, aerogel, aerogel blanket, asbestos, aluminum silicate, calcium silicate, diatomite, zirconium oxide, etc. The thermal insulative tube 5 can also be a vacuum insulative tube.

In a preferred embodiment, the heater 1 further includes a temperature collecting module (not shown in figures) fixed on the base 11. The temperature collecting module is used to collect temperature data of the base 11 in order to conveniently control temperatures of the heater 1.

The temperature collecting module includes a temperature sensor 2 (Referring to FIG. 8) and/or a digital temperature detecting module. The temperature sensor 2 includes, but not being limited to, a temperature sensor for negative temperature coefficient (shorten as NTC), positive temperature coefficient (shorten as PTC), etc. The digital temperature detecting module is a digital output type of a temperature detecting module. Existing technology can be referred in details, and therefore no limitation thereof is set herein.

Figure 7:
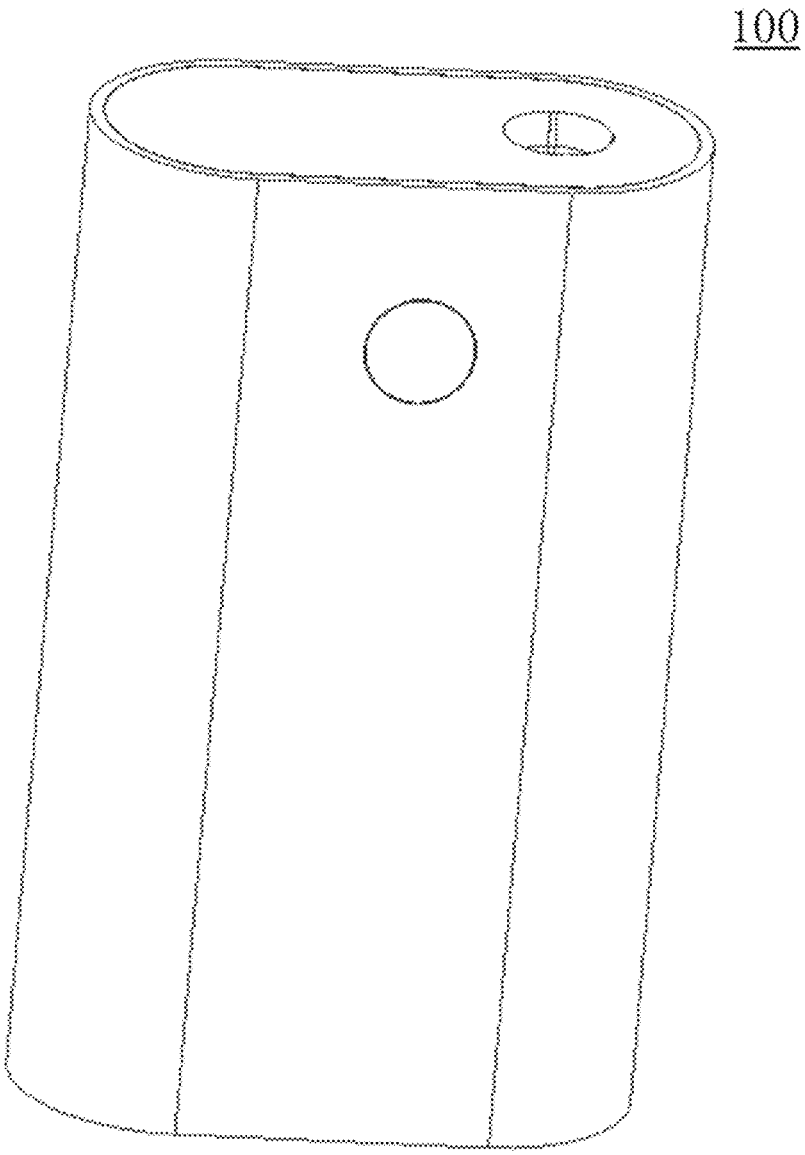
FIG. 7 shows a schematic perspective view of a cigarette device in accordance with a second preferred embodiment of the present invention.

Referring to FIGS. 7-8, a cigarette device 100 in accordance with a second embodiment of the present invention is shown. The cigarette device 100 includes a housing assembly 6 and the above described heater 1. The heater 1 is disposed in the housing assembly 6. In the cigarette device 100 in accordance with the second embodiment of the present invention, the infrared electric-heating coating layer 12 is coated to cover the outer surface of the base 11, and the first conducting part 131 and the second conducting part 132 are disposed on the outer surface of the base 11 to be electrically connected with the infrared electric-heating coating layer 12. The first conducting part 131 and the second conducting part 132 are respectively disposed alternately on the base 11 in an equidistant spiral spacing along the longitudinal direction of the cylindrical base 11. The infrared electric-heating coating layer 12 can emit infrareds toward the aerosol generating substrate in the cavity 111 of the base 11 for radiant heating.

The housing assembly 6 includes a shell 61, a fixing case 62, a fixing piece 63 and a bottom cover 64. The fixing case 62 and the fixing piece 63 are both fixed in the shell 61. The bottom cover 64 is disposed at an end of the shell 61 to cover the shell 61. In particular, the fixing piece 63 includes an upper fixing seat 631 and a lower fixing seat 632. The upper fixing seat 631 and the lower fixing seat 632 are both fixed in the fixing case 62. The first end and the second end of the base 11 are respectively fixed on the upper fixing seat 631 and the lower fixing seat 632. An air inlet tube 641 is protrusively disposed at the bottom cover 64. An end of the lower fixing seat 632 facing away from the upper fixing seat 631 is connected with the air inlet tube 641. The upper fixing seat 631, the base 11, the lower fixing seat 632 and the air inlet tube 641 are coaxially disposed. Besides, the base 11 is sealed between the upper fixing seat 631 and the lower fixing seat 632. The lower fixing seat 632 and the air inlet tube 641 are sealed to be connected. The air inlet tube 641 is spatially communicated with external air so that the external air can smoothly enter when users smoke.

The cigarette device 100 further includes a main control circuit board 3 and a battery 7. The fixing case 62 includes a front case 621 and a rear case 622. The front case 621 and the rear case 622 are fixedly connected. The main control circuit board 3 and the battery 7 are both disposed in the fixing case 62. The battery 7 is electrically connected with the main control circuit board 3. A button 4 is protrusively disposed at the shell 61. The infrared electric-heating coating layer 12 disposed on the outer surface of the base 11 can be electrified or electrically disconnected through pressing the button 4. The main control circuit board 3 further includes a power charging port 31. The power charging port 31 is exposed at the bottom cover 64. Users can charge power or upgrade software to the cigarette device 100 through the power charging port 31 in order to ensure continuous use of the cigarette device 100.

The cigarette device 100 further includes the thermal insulative tube 5. The thermal insulative tube 5 is disposed in the fixing case 62. The thermal insulative tube 5 is disposed to surround and cover the base 11. A large amount of heat can be avoided by the thermal insulative tube 5 to be transmitted to the shell 61 and further to lead to hand burning for users. In particular, the reflective coating layer is further coated on the inner surface of the thermal insulative tube 5 in order to reflect infrareds transmitted from the infrared electric-heating coating layer 12 on the base 11 back to the inside of the base 11 for heating the aerosol generating substrate disposed in the cavity 111 and therefore for enhancing heating efficiency.

The cigarette device 100 further includes an NTC temperature sensor 2 to sense a real-time temperature of the base 11, and to transmit the sensed real-time temperature to the main control circuit board 3. The main control circuit board 3 adjusts an amount of electric currents passing through the infrared electric-heating coating layer 12 according to the sensed real-time temperature. In particular, when the NTC temperature sensor 2 detects a lower real-time temperature in the base 11, for example, the NTC temperature sensor 2 detects a temperature inside the base 11 being less than 150° C., the main control circuit board 3 controls the battery 7 to output a higher electric voltage to the conductor 13 in order to raise electric currents fed in the infrared electric-heating coating layer 12, and to raise heating power onto the aerosol generating substrate for reducing a waiting time of a user inhaling a first puff. When the NTC temperature sensor 2 detects a temperature of the base 11 being 150° C.~200° C., the main control circuit board 3 controls the battery 7 to output a normal electric voltage to the conductor 13. When the NTC temperature sensor 2 detects a temperature of the base 11 being 200° C.~250° C., the main control circuit board 3 controls the battery 7 to output a lower electric voltage to the conductor 13. When the NTC temperature sensor 2 detects a temperature inside the base 11 being 250° C. or more than 250° C., the main control circuit board 3 controls the battery 7 to stop outputting any electric voltage to the conductor 13.

It should be noted that the specification of the present invention and its accompanying drawings provides preferred embodiments of the present invention. However, the present invention can be implemented in many different forms and is not limited to the preferred embodiments described in this specification. These preferred embodiments are not intended to make additional restrictions on the content of the present invention, and the purpose of providing the preferred embodiments is to make understanding of the disclosure of the present invention become more thorough and comprehensive. In addition, the above technical features continue to be combined with one another to form various embodiments not listed above, the combinations are all regarded as being within the scope of the description of the present invention. Furthermore, for those of ordinary skill in the art, improvements or transformations can be made based on the above descriptions, and all these improvements and transformations should belong to the protection scope of the appended claims of the present invention.

What is claimed is:

1. A heater, wherein the heater comprises:

a base having a surface;

an infrared electric-heating coating layer disposed on the surface of the base, the infrared electric-heating coating layer used to generate an infrared for radiantly heating an aerosol generating substrate in order to generate aerosols for inhaling;

a conductor comprising a first conducting part and a second conducting part disposed on the surface of the base, both of the first conducting part and the second conducting part being at least partially electrically connected with the infrared electric-heating coating layer so that electric currents travel through the infrared electric-heating coating layer from one of the first conducting part and the second conducting part toward the other of the first conducting part and the second conducting part;

wherein the first conducting part comprises a first electric conducting spiral section, and the second conducting part comprises a second electric conducting spiral section, a spacing between the first electric conducting spiral section and the second electric conducting spiral section is not zero.

2. The heater as claimed in claim 1, wherein the first electric conducting spiral section and the second electric conducting spiral section respectively extend along a longitudinal direction of the base.

3. The heater as claimed in claim 2, wherein the first electric conducting spiral section and the second electric conducting spiral section respectively extend in an equidistant spiral spacing along the longitudinal direction of the base.

4. The heater as claimed in claim 3, wherein a spiral distance of the first electric conducting spiral section is equal to a spiral distance of the second electric conducting spiral section.

5. The heater as claimed in claim 4, wherein the spacing between the first electric conducting spiral section and the second electric conducting spiral section is same; or, the spacing between the first electric conducting spiral section and the second electric conducting spiral section is not same.

6. The heater as claimed in claim 3, wherein a spiral distance of the first electric conducting spiral section and a spiral distance of the second electric conducting spiral section are unequal.

7. The heater as claimed in claim 2, wherein at least one of the first electric conducting spiral section and the second electric conducting spiral section extends, or both of the first electric conducting spiral section and the second electric conducting spiral section respectively extend, in a varying spiral spacing along the longitudinal direction of the cylindrical base.

8. The heater as claimed in claim 7, wherein the surface of the base at least comprises a first area and a second area;

a spiral spacing of the first electric conducting spiral section in the first area is larger than a spiral spacing of the first electric conducting spiral section in the second area, and a spiral spacing of the second electric conducting spiral section in the first area is larger than a spiral spacing of the second electric conducting spiral section in the second area.

9. The heater as claimed in claim 8, wherein the first area is disposed near an upstream part of the aerosol generating substrate while the second area is disposed near a downstream part of the aerosol generating substrate.

10. The heater as claimed in claim 1, wherein the first conducting part further comprises a first electric conducting non-spiral section, and/or, the second conducting part further comprises a second electric conducting non-spiral section.

11. The heater as claimed in claim 1, wherein the first conducting part and the second conducting part are respectively one of the followings:

an electric conducting coating layer coated on the infrared electric-heating coating layer;

an electric conducting piece adhered and attached onto the infrared electric-heating coating layer.

12. The heater as claimed in claim 1, wherein an electrical conductivity of the first conducting part and an electrical conductivity of the second conducting part are both higher than an electrical conductivity of the infrared electric-heating coating layer.

13. The heater as claimed in claim 1, wherein the heater further comprises a protective layer coated on the infrared electric-heating coating layer and/or a protective structure disposed on the infrared electric-heating coating layer to avoid abrasion of the infrared electric-heating coating layer.

14. The heater as claimed in claim 1, wherein the heater further comprises a hollow thermal insulative tube;

the thermal insulative tube is disposed to surround outside the base.

15. The heater as claimed in claim 14, wherein an inner surface of the thermal insulative tube is coated with a reflective coating layer.

16. The heater as claimed in claim 1, wherein the heater further comprises a temperature collecting module fixed on the base;

the temperature collecting module is used to collect temperature data of the base.

17. A cigarette device, wherein the cigarette device comprises a housing assembly and a heater disposed in the housing assembly;

the heater comprises:

a base having a surface;

an infrared electric-heating coating layer disposed on the surface of the base, the infrared electric-heating coating layer used to generate an infrared for radiantly heating an aerosol generating substrate in order to generate aerosols for inhaling;

a conductor comprising a first conducting part and a second conducting part disposed on the surface of the base, both of the first conducting part and the second conducting part being at least partially electrically connected with the infrared electric-heating coating layer so that electric currents travel through the infrared electric-heating coating layer from one of the first conducting part and the second conducting part toward the other of the first conducting part and the second conducting part;

wherein the first conducting part comprises a first electric conducting spiral section, and the second conducting part comprises a second electric conducting spiral section, a spacing between the first electric conducting spiral section and the second electric conducting spiral section is not zero.

18. The cigarette device as claimed in claim 17, wherein the first electric conducting spiral section and the second electric conducting spiral section respectively extend in an equidistant spiral spacing along a longitudinal direction of the base.

19. The cigarette device as claimed in claim 17, wherein the heater further comprises a hollow thermal insulative tube;

the thermal insulative tube is disposed to surround outside the base.

20. The cigarette device as claimed in claim 19, wherein an inner surface of the thermal insulative tube is coated with a reflective coating layer.

* * * * *